US011270624B2

(12) United States Patent
Zhang et al.

(10) Patent No.: US 11,270,624 B2
(45) Date of Patent: Mar. 8, 2022

(54) GATE DRIVER CIRCUIT INCLUDING SHIFT REGISTER WITH HIGH STABILITY AND LOW POWER CONSUMPTION

(71) Applicant: PEKING UNIVERSITY SHENZHEN GRADUATE SCHOOL, Shenzhen (CN)

(72) Inventors: Shengdong Zhang, Shenzhen (CN); Yihua Ma, Shenzhen (CN); Congwei Liao, Shenzhen (CN)

(73) Assignee: Peking University Shenzhen Graduate School, Guangdong (CN)

( * ) Notice: Subject to any disclaimer, the term of this patent is extended or adjusted under 35 U.S.C. 154(b) by 53 days.

(21) Appl. No.: 16/496,427

(22) PCT Filed: May 11, 2017

(86) PCT No.: PCT/CN2017/083983
§ 371 (c)(1),
(2) Date: Sep. 21, 2019

(87) PCT Pub. No.: WO2018/171015
PCT Pub. Date: Sep. 27, 2018

(65) Prior Publication Data

US 2021/0110757 A1 Apr. 15, 2021

(30) Foreign Application Priority Data

Mar. 21, 2017 (CN) ..... 201710168933.5

(51) Int. Cl.
*G09G 5/00* (2006.01)
*G09G 3/20* (2006.01)
(Continued)

(52) U.S. Cl.
CPC ..... *G09G 3/2092* (2013.01); *G09G 3/3208* (2013.01); *G09G 3/3677* (2013.01);
(Continued)

(58) Field of Classification Search
CPC ..... G09G 3/2092; G09G 2310/0275; G09G 2310/0286; G09G 3/3677; G09G 3/3208
See application file for complete search history.

(56) References Cited

U.S. PATENT DOCUMENTS

2007/0247932 A1* 10/2007 Tobita ..... G11C 19/28 365/189.12
2008/0055225 A1* 3/2008 Pak ..... G09G 3/3677 345/96

(Continued)

FOREIGN PATENT DOCUMENTS

CN 104485065 A 4/2015
CN 105741802 A 7/2016

OTHER PUBLICATIONS

Chinese Office Action dated Jun. 20, 2019, issued in corresponding Chinese Patent Application No. 201710168933.5.

(Continued)

*Primary Examiner* — Adam J Snyder
(74) *Attorney, Agent, or Firm* — Morgan, Lewis & Bockius LLP

(57) ABSTRACT

The present disclosure includes a shift register unit circuit, including input storing module, configured to receive an input signal at an input terminal and store the input signal; storage retrieving module, configured to retrieve the input signal from the input storing module under influence of at least a first clock signal; output driving module, configured to transfer the input signal to an first output terminal under control of the storage retrieving module; and pulling-down and maintaining module, configured to pull down a voltage at the output terminal to low voltage level after output operation is completed, and maintain the voltage at low voltage level until the output driving module receives a next input signal. The present disclosure also includes a gate
(Continued)

driver circuit including such shift register units and a method for generating gate driving signal.

14 Claims, 7 Drawing Sheets

(51) Int. Cl.
*G09G 3/36* (2006.01)
*G09G 3/3208* (2016.01)

(52) U.S. Cl.
CPC ..... *G09G 2310/0275* (2013.01); *G09G 2310/0286* (2013.01)

(56) References Cited

U.S. PATENT DOCUMENTS

2010/0110047 A1* 5/2010 Yoon ..... G09G 3/3677 345/204
2011/0116592 A1* 5/2011 Tsai ..... G11C 19/184 377/79
2014/0119492 A1* 5/2014 Liu ..... G11C 19/28 377/64
2015/0043703 A1* 2/2015 Tan ..... G11C 19/184 377/68

OTHER PUBLICATIONS

International Search Report and Written Opinion dated Dec. 27, 2017, issued in corresponding International Patent Application No. PCT/CN2017/083983.

* cited by examiner

GATE DRIVER CIRCUIT INCLUDING SHIFT REGISTER WITH HIGH STABILITY AND LOW POWER CONSUMPTION

TECHNICAL FIELD

Aspects of the present disclosure relate to active matrix display technology, and more particularly, to a gate driver circuit.

BACKGROUND

As display devices progress to the direction of high resolution and narrow bezel, displays with integrated driving circuit become a hot topic in the research field of display driving. Currently, TFTs (Thin Film Transistors) are already applied in fabrication of display. Using TFT technology to implement gate driver circuit of display may reduce the number of peripheral chips and simply fabrication process, therefore lower production cost. Further, integration level of modules may also be increased; physical reliability may also be strengthened, therefore light-weighted and thin display with narrow bezel or no bezel. The ultimate goal of research for display integrated with driving circuit is to achieve complete system on panel (SOP).

Integration of gate driver circuits has drawn attention from academy and industry long ago. There are three ways to achieve integrated gate driver circuit using TFT technology: hydrogenated amorphous silicon TFT, low temperature amorphous silicon TFT, and oxide TFT. Hydrogenated amorphous silicon TFT is mainstream TFT technology in the field of display, which has high mobility but low uniformity, and is mainly adopted to fabricate display with small size and high resolution. Oxide TFT is deemed as the next generation TFT technology, which has high mobility and high uniformity, and is compatible with amorphous silicon fabrication process, suitable for display with high resolution. The development of TFT technology also promotes display to approach the goal of SOP.

SUMMARY

The present application discloses a switch capacitor voltage self-lift circuit as a shift register unit with high stability and low power consumption, a gate driver circuit including such shift register units, and a display thereof.

The present application discloses a shift register unit circuit, including input storing module, configured to receive an input signal at an input terminal and store the input signal; storage retrieving module, configured to retrieve the input signal from the input storing module under influence of at least a first clock signal; output driving module, configured to transfer the input signal to an first output terminal under control of the storage retrieving module; and pulling-down and maintaining module, configured to pull down a voltage at the output terminal to low voltage level after output operation is completed, and maintain the voltage at low voltage level until the output driving module receives a next input signal.

Specifically, the input storing module includes, a storing capacitor configured to store the input signal, a first side of the storing capacitor is coupled to the input terminal through a first switch, a second side of the storing capacitor is coupled to low voltage supply through a second switch, status of the first and second switches is under control of the input signal; the output driving module includes, a first transistor including a first electrode coupled to high voltage supply, a second electrode coupled to the output terminal and the pulling-down and maintaining module, and a third electrode coupled to the storage retrieving module; the storage retrieving module includes, a third switch coupled between the first side of the storing capacitor and the third electrode of the first transistor, and a fourth switch coupled between the second side of the storing capacitor and the output terminal, wherein status of the third and fourth switches is under influence of the first clock signal.

Specifically, the output driving module further includes a second transistor including a first electrode coupled to high voltage supply, a second electrode coupled to a second output terminal, a third electrode coupled to the third electrode of the first transistor, wherein size of the first transistor is larger than size of the second transistor.

Specifically, the first switch is a third transistor including a first electrode and a third electrode which are coupled to the input terminal, and a second electrode coupled to the first side of the storing capacitor; the second switch is a fourth transistor including a first electrode coupled to the second side of the storing capacitor, a second electrode coupled to low voltage supply, and a third electrode coupled to the input terminal, when the input signal is at high voltage level, the first and second switches are turned on, and the storing capacitor is charged.

Specifically, the third switch is a fifth transistor including a first electrode coupled to the first side of the storing capacitor, a second electrode coupled to the third electrode of the first transistor, a third electrode coupled to a first clock signal input terminal; the fourth switch is a sixth transistor including a first electrode coupled to the second side of the storing capacitor, a second electrode coupled to the output terminal, a third electrode the first clock signal input terminal; the first clock signal reaches high voltage level after charging of the first capacitor is completed, and the third and fourth switches are turned on.

Specifically, the storage retrieving module further includes a seventh transistor and an eighth transistor, wherein the seventh transistor includes a first and a third electrodes coupled to the first clock signal input terminal, and a second electrode coupled to the third electrodes of the fifth and the sixth transistors; the eighth transistor includes a first electrode coupled to the second electrode of the seventh transistor, a second electrode coupled to low voltage supply, a third electrode coupled to a discharge control signal input terminal, so that during charging of the storing capacitor, the third and the fourth switches are turned off.

Specifically, the pulling-down and maintaining module includes a ninth transistor and a tenth transistor, wherein the ninth transistor includes a first electrode coupled to the third electrode of the first transistor, a second electrode coupled to low voltage supply, a third electrode coupled to a pulling-down and maintaining control signal input terminal; the tenth transistor includes a first electrode coupled to the output terminal, a second electrode couple to low voltage supply, and a third electrode the pulling-down and maintaining control signal input terminal.

Specifically, the pulling-down and maintaining module includes a pulling-down sub-module and a maintaining sub-module, wherein the pulling-down sub-module includes an eleventh transistor and a twelfth transistor, second electrodes of these two transistors are coupled to low voltage supply, third electrodes of these two transistors are coupled to the pulling-down control signal input terminal, wherein a first electrode of the eleventh transistor is coupled to the third electrode of the first transistor, a first electrode of the twelfth transistor is coupled to the second electrode of the first transistor and the output terminal; and the maintaining sub-module incudes a fourteenth transistor and a fifteenth transistor, second electrodes of these two transistors are coupled to low voltage supply, third electrodes of these two transistors are coupled to a second clock signal input terminal, wherein a first electrode of the fourteenth transistor is coupled to the third electrode of the first transistor, a first electrode of the fifteenth transistor is coupled to the second electrode of the first transistor and the output terminal.

Specifically, the pulling-down and maintaining module includes a pulling-down sub-module and a maintaining sub-module, wherein the pulling-down sub-module includes an eleventh transistor, a twelfth transistor and a thirteenth transistor, second electrodes of these three transistors are coupled to low voltage supply, third electrodes of these three transistors are coupled to the pulling-down control signal input terminal, wherein a first electrode of the eleventh transistor is coupled to the third electrodes of the first transistor and the second transistor, a first electrode of the twelfth transistor is coupled to the second electrode of the first transistor and the output terminal, and a first electrode of the thirteenth transistor is coupled to the second electrode of the second transistor and the second output terminal; and the maintaining sub-module incudes a fourteenth transistor, a fifteenth transistor and a sixteenth transistor, second electrodes of these three transistors are coupled to low voltage supply, third electrodes of these three transistors are coupled to a second clock signal input terminal, wherein a first electrode of the fourteenth transistor is coupled to the third electrodes of the first transistor and the second transistor, a first electrode of the fifteenth transistor is coupled to the second electrode of the first transistor and the output terminal, and a first electrode of the sixteenth transistor is coupled to the second electrode of the second transistor and the second output terminal.

The present application also discloses a gate driver circuit, including a shift register which includes M cascaded units, wherein any one of a first to the M−1th units includes the circuit according to any of the preceding shift register units, wherein an input terminal of the Nth unit is coupled to a second output terminal of the N−1th unit, a pulling-down control input terminal of the Nth unit is coupled to a second output terminal of the N+1th unit, a discharge control signal input terminal of the N-th unit is coupled to a second output terminal of the N−2th unit, wherein M is an integer greater than 4, N is an integer greater than 3 and no more than M−1; wherein an input terminal of the first unit is configured to receive an initial input signal, a discharge control signal input terminal is configured to receive an initial discharge control signal, a pulling-down control signal input terminal of the first unit is coupled to a second output terminal of the second unit; a discharge control signal input terminal of the second unit is configured to receive the initial input signal, an input terminal of the second unit is coupled to a second output terminal of the first unit, and a pulling-down control signal input terminal of the second unit is coupled to a second output terminal of the third unit.

Specifically, the Mth unit has a circuit structure according to the shift register unit of claim 2, wherein the Mth unit is only configured to provide a pulling-down control signal to the M−1th unit.

The present application also discloses a display, including a pixel array, a data driver circuit coupled with the pixel array, and a gate driver circuit according to the preceding coupled with the pixel array.

Specifically, the display is a TFT display and the gate driver circuit is fabricated on the same substrate as the pixel array.

The present application also presents a method for generating gate driving signal for a display, including following operations executed by each unit of a shift register of a gate driver circuit of the display, wherein each of the shift register units includes an input storing module, a storage retrieving module, an output driving module, and a pulling-down maintaining module, wherein the method includes receiving and storing an input signal by the input storing module; transferring the stored input signal to the output driving module by the storage retrieving module at least under influence of a clock signal; transferring the input signal to an output terminal by the output driving module under control of the storage retrieving module; and pulling down, by the pulling down and maintaining module, a voltage at the output terminal to low voltage level after output operation is completed, and maintaining, by the pulling down and maintaining module, the voltage at the output terminal at low voltage level before a next input signal is received by the output driving module.

The gate driver circuit and the display disclosed in this application avoid connecting the driving transistor directly with clock signals, which therefore suppresses the clock feedthrough and dynamic consumption, and greatly lowers power consumption of the circuit and reduces voltage fluctuation at internal nodes of the circuit during the low voltage level maintaining stage. On the other hand, using a single low power supply to achieve the goal of circuit design reduces complexity of routing and the total area of the circuit.

Embodiments of are explained in view of the figures as follow.

BRIEF DESCRIPTION OF THE DRAWINGS

For a better understanding of the various described embodiments, reference should be made to the Description of Disclosure below, in conjunction with the following drawings in which like reference numerals refer to corresponding parts throughout the figures.

Like reference numerals refer to corresponding parts throughout the several views of the drawings.

DESCRIPTION OF DISCLOSURE

Figure 1:
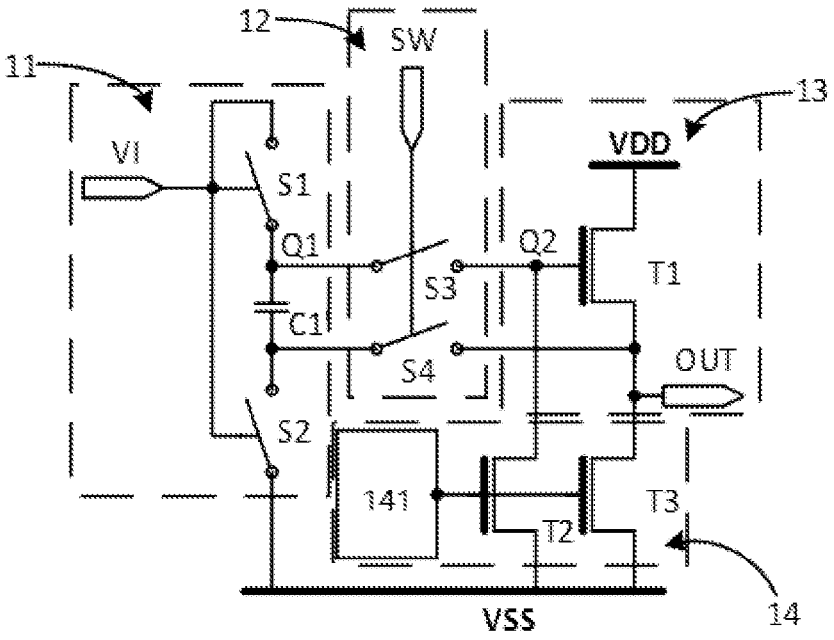
FIG. 1 is an exemplary structural diagram of a shift register unit circuit in accordance with one embodiment of the present application.

The application will be further described below in detail through specific embodiments with reference to the accompanying drawings. It should be noted that, the relative arrangement of components and steps, numerical equations and values are not directed to limit the scope of the application, unless with particular explanation.

The description of at least one embodiment below is for illustration purpose, and is not for limiting the present application and its use.

Regarding technology, methods, devices that are well known to those of ordinary skill in the art, no detailed discussion is provided, but under proper circumstance, those technology, methods and devices should be deemed as part of the application.

Any values listed in following examples are for illustration purpose, rather than limiting purpose. Thus, in other examples, other values could be used.

It should be noted that similar reference numerals refer to similar items in the drawings. Therefore, once one item is defined with regards to one drawing, no further definition is needed in the following drawings for the similar ones.

Most current gate driver circuits adopt the GOA (Gate driver On Array) structure disclosed by Thomson Microelectronics, Inc. in 1993, which utilized self-lift effect of the gate driving voltage to obtain higher driving voltage to drive load of the output transistor, in order to increase driving capability of the circuit. Many entities have done thorough research based on this structure. Voltage self-lift technology is needed when charging the output node of the GOA circuit due to the fact that only N-type transistors are available in mainstream TFT technology.

However, current voltage self-lift circuits are facing problems of large dynamic power consumption and clock feedthrough. Such problems would cause severe negative influence on circuit performance under the ESL (Etch Stop Layer) process. In the structure of current gate driver circuit, such as the GOA structure, the first electrode of the output transistor is connected to clock signal, and the periodical change of the clock signal together with the parasitic capacitance of the output transistor may cause dynamic power consumption. In the low voltage maintaining stage, due to the periodical change of the clock signal, voltages at nodes within the gate driver circuit fluctuate according to the change of the clock signal, and may lead to clock feedthrough. In addition, in traditional gate driver circuits, two levels of low voltage are adopted so that during the low voltage maintaining stage, the voltage at the third electrode (e.g. the gate voltage) of the output transistor may be lower than the voltage at the second electrode (e.g. the source voltage), in order to suppress the leakage power consumption of the output transistor. However, the increase of number of low voltage supply and according routing arrangement may increase complexity and area of the circuit.

Therefore, suppressing clock feedthrough and reducing dynamic power consumption under the premise of maintaining driving capability are the two problems to be solved for current gate driver circuits.

Embodiments are further explained in view of drawings.

Firstly, transistors in the application can be transistors having any structure, e.g., a field-effect transistor (FET) or a bipolar junction transistor (BJT). When the transistor is a field-effect transistor, a first electrode can be a drain or source of the field-effect transistor, and correspondingly a second electrode can be a source or drain of the field-effect transistor, and a third electrode thereof is a gate of the field-effect transistor. When the transistor is a bipolar junction transistor, a first electrode can be a collector or emitter of the bipolar junction transistor, and correspondingly a second electrode can be an emitter or collector of the bipolar junction transistor, a third electrode thereof is a base of the bipolar junction transistor. Transistors in the display may be TFT devices. When transistors are used as switches, the first and second electrodes are interchangeable. In the present application, the optical device may be OLED or other light emitting devices. Unless otherwise stated, transistors in the present application refer to N-type field effect transistors or NPN bipolar transistors.

The following is explained using field effect transistors as examples. Those implemented with bipolar transistors are well within the protection scope of the present application.

FIG. 1 shows a structure diagram of a shift register unit circuit according to one embodiment of the present application. In one embodiment, the circuit may include input storing module 11, storage retrieving module 12, output driving module 13, and pull-down and maintaining module 14.

According to one embodiment, input storing module 11 may include storing capacitor C1, switch S1 coupled between a first side of C1 and signal input terminal VI, and switch S2 coupled between a second side of C1 and low voltage supply VSS. Status of switches S1 and S2 is controlled by input signals received at input terminal VI.

According to one embodiment, storage retrieving module 12 may include switch 13 coupled between the first side of C1 (node Q1) and output driving module 13, and switch S4 coupled between the second side of C1 and output driving module 13, and switch controlling terminal SW is configured to receive a controlling signal which controls status of switches S3 and S4. According to one embodiment, the controlling signal may be a clock signal as shown in FIG. 2.

According to one embodiment, output driving module 13 may include output transistor T1 which has a first electrode coupled to high voltage supply VDD, a third electrode coupled to switch S3 at node Q2, and a second electrode coupled to output terminal OUT. Also, output terminal OUT is coupled to switch S4 as illustrated in FIG. 1.

According to one embodiment, pull-down and maintaining module 14 may include transistors T2 and T3. A first electrode of transistor T2 to a third electrode of transistor T1, a first electrode of transistor T3 is coupled to output terminal OUT, second electrodes of transistors T2 and T3 are coupled to the low voltage supply VSS, and third electrodes of transistors T2 and T3 are coupled to a sub-module 141 which is configured to generate a controlling signal of pull-down and maintaining.

Figure 2:
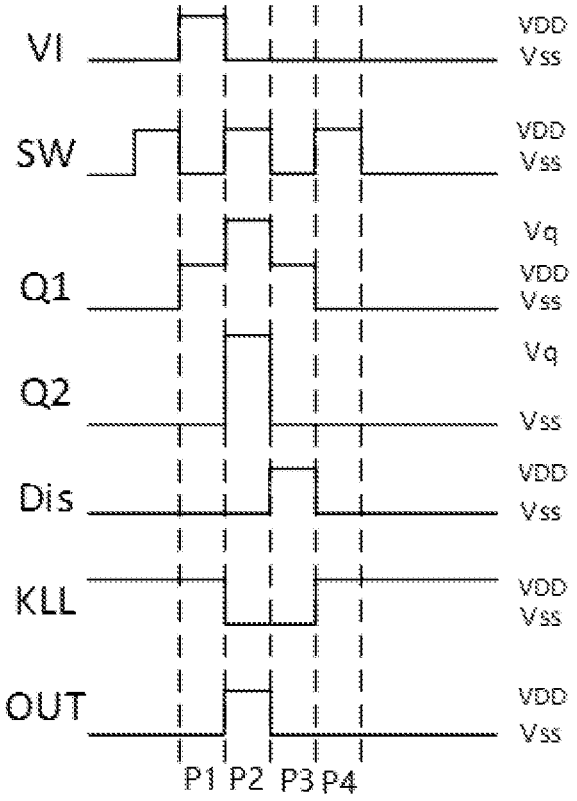
FIG. 2 is an exemplary sequence diagram of the circuit in FIG. 1.

FIG. 2 is an exemplary sequence diagram of the circuit in FIG. 1. According to one embodiment, working sequence of the circuit in FIG. 1 can be divided into pre-charging phase P1, pull-up phase P2, pull-down phase P3 and low voltage maintaining phase P4. The four phases are introduced as follow.

(1) Pre-Charging Phase P1

During this phase, the input signal received at input terminal VI is at high voltage level, switches S1 and S2 are turned on, capacitor C1 is charged. During this phase, the signal received at controlling terminal SW is at low voltage level, switches S3 and S4 are turned off. Voltage at the third electrode of output transistor T1 and node Q2 is maintained at low voltage level, transistor T1 is turned off, and therefore voltage at output terminal OUT is at low voltage level.

(2) Pull-Up Phase P2

During this phase, the input signal received at input terminal VI falls to low voltage level, switches S1 and S2 are turned off, and no input signal is further received. The controlling signal received at controlling terminal SW rises to high voltage level, switches S3 and S4 are turned on, capacitor C1 is discharged, the voltage at node Q1 is transferred to node Q2 which leads to rising of the voltage at node Q2, and transistor T1 is turned on which charges output terminal OUT. Since the first side of C1 and node Q1 are floating, and the second side of C1 is coupled to output terminal OUT, as the voltage at output terminal OUT rises to high voltage level, the voltage at floating node Q1 rises accordingly. Therefore, voltage at node Q2 also rises to a level (Vq) that is higher than the high voltage level VDD, and rising speed of the voltage at output terminal is guaranteed. Such an effect is called self-lift effect.

(3) Pull-Down Phase P3

During this phase, the controlling signal received at controlling terminal SW falls to low voltage level, switches S3 and S4 are turned off, output transistor T1 is turned off, the pull-down signal Dis received at the third electrodes of transistor T2 and T3 rises to high voltage level, voltages at output terminal OUT and node Q2 are pulled down to low voltage level VSS. In one embodiment, voltage at node Q1 is not discharged to low voltage level VSS during this phase, rather the voltage at node Q1 drops down to e.g. VDD. As illustrated in FIG. 2, the controlling signal received at controlling terminal SW is a clock signal which is at low voltage level during this phase. Therefore, node Q1 is not connected to Q2 during this phase, and voltage at Q1 cannot drop down to low voltage level VSS during this phase. Since the voltage at output terminal OUT drops down to low voltage level, under capacitors' coupling effect, the voltage at Q1 falls from Vq to VDD.

(4) Low Voltage Maintaining Phase P4

During and after this phase, the low voltage maintaining signal KLL received at the third electrodes of transistor T2 and T3 rises to high voltage level, which maintains the voltages at output terminal OUT and node Q2 at low voltage level VSS. As shown in FIG. 2, in this embodiment, the voltage received at terminal SW reaches high voltage level. In this embodiment, as shown in FIG. 2, the signal received at terminal SW rises to high voltage level, node Q1 is connected to node Q2 during this phase and is discharged to low voltage level. As shown in FIG. 2, the low voltage maintaining signal KLL is at low voltage level during P2 and P3, and is at high voltage level during other phases. According to other embodiments, KLL can be of other forms, as long as it is kept at low voltage level during phase P2.

In the circuit of the embodiment, through the voltage storing and transferring by the capacitor(s), self-lift effect is achieved while having the first electrode of the output transistor coupled to a positive power supply VDD, so that speed of the circuit is maintained and the dynamic power consumption and clock feedthrough problems, caused by the traditional circuit structure in which the output transistor is directly connected to clock signal, are avoided. Such a circuit structure may greatly reduce total power consumption, and increase circuit stability.

In the circuit introduced in the embodiment, the signal received at switch controlling terminal SW is every important. FIG. 1 is just an example to show the main structural characteristic of switch capacitor self-lift circuit, and it is not limited to using clock signal at terminal SW to control the status of switches S3 and S4. Self-lift circuits or shift register unit circuits, which adopt the storing and retrieving scheme, have their output transistors connected to high voltage supply, and the storing and retrieving modules of such circuits are controlled by clock signals, are within the protection scope of the present application. Regarding the circuit to generate the switch controlling signal, there may be variations according to practical needs and requirement. A series of examples are provided as follow.

Figure 3:
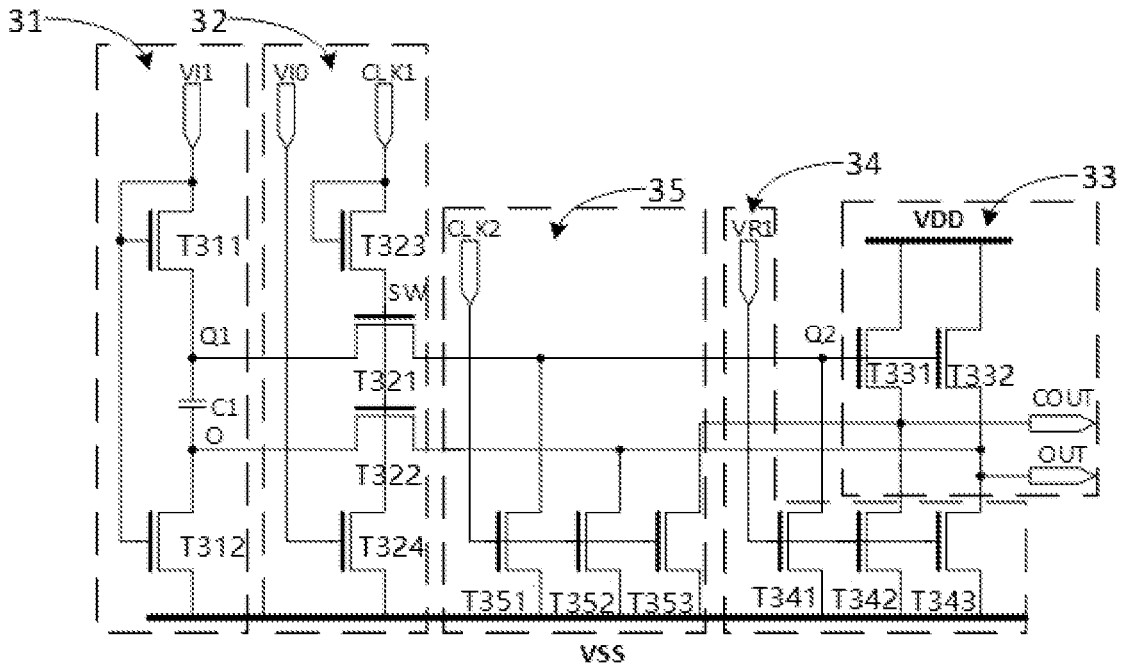
FIG. 3 is an exemplary structural diagram of a shift register unit circuit in accordance with one embodiment of the present application.

FIG. 3 shows a structure diagram of a shift register unit circuit according to one embodiment of the present application. The circuit may include input storing module 31, storage retrieving module 32, output driving module 33, pull-down module 34, and low voltage maintaining module 35.

According to one embodiment, input storing module 31 may include storage capacitor C1 and transistors T311 and T312. A first and a third electrodes of transistor T311 are coupled to input terminal VI1, and a second electrode coupled to a first side of capacitor C1 and node Q1. A first electrode of transistor T312 is coupled to a second side of capacitor C1, a second electrode of T312 is coupled to low voltage supply VSS, and a third node of transistor T312 is coupled to input terminal VI1.

According to one embodiment, storage retrieving module 32 may include transistors T321 and T322 for transferring stored voltage. A first electrode of transistor T321 is coupled to the first side of capacitor C1 and node Q1, a first electrode of transistor T322 is coupled to the second side of capacitor C1. Third electrodes of transistor T321 and T322 are coupled to terminal SW which is configured to receive a controlling signal to control transistors T321 and T322.

According to one embodiment, storage retrieving module 32 may further include transistors T323 and T324. A first electrode and a third electrode of transistor T323 are coupled to a first clock signal input terminal CLK1, a second electrode of transistor T323 is coupled to terminal SW which is also coupled with the third electrodes of transistors T321 and T322. A first electrode of transistor T324 is coupled to a second electrode of transistor T323, a second electrode of transistor T324 is coupled to low voltage supply VSS, and a third electrode of T324 is coupled to discharge controlling signal input terminal VI0.

According to one embodiment, output driving module 33 may include output transistors T331 and T332. First electrodes of transistors T331 and T332 are coupled to high voltage supply VDD, third electrodes of T331 and T332 are coupled to the second electrode of transistor T321 and node Q2. A second electrode of transistor T331 is coupled to cascade output terminal COUT, and a second electrode of T332 is coupled to output terminal OUT. In one embodiment, signal at cascade output terminal COUT is not used for load driving, but to be used by other shift register unit(s) as input or control signals. Thus, in one embodiment, size of output transistor T332 is larger than size of output transistor T331.

In one embodiment, pull-down module 34 may include pull-down transistor T341 of node Q2, pull-down transistor T342 of terminal COUT, pull-down transistor T343 of terminal OUT. Second electrodes of such three transistors are coupled to low voltage supply VSS, and third electrodes of such three transistors are coupled to pull-down control signal input terminal VR1. And the difference is that a first electrode of T341 is coupled to node Q2, a first electrode of T342 is coupled to terminal COUT, and a first electrode of T343 is coupled to terminal OUT.

According to one embodiment, low voltage maintaining module 35 may include transistors T351, T352 and T353, second electrodes of which are coupled to low voltage supply VSS, third electrodes of which are coupled to a second clock input terminal CLK2. The difference lies in that a first electrode of T351 is coupled to node Q2, a first electrode of T352 is coupled to terminal COUT, and a first electrode of T353 is coupled to terminal OUT.

Figure 5:
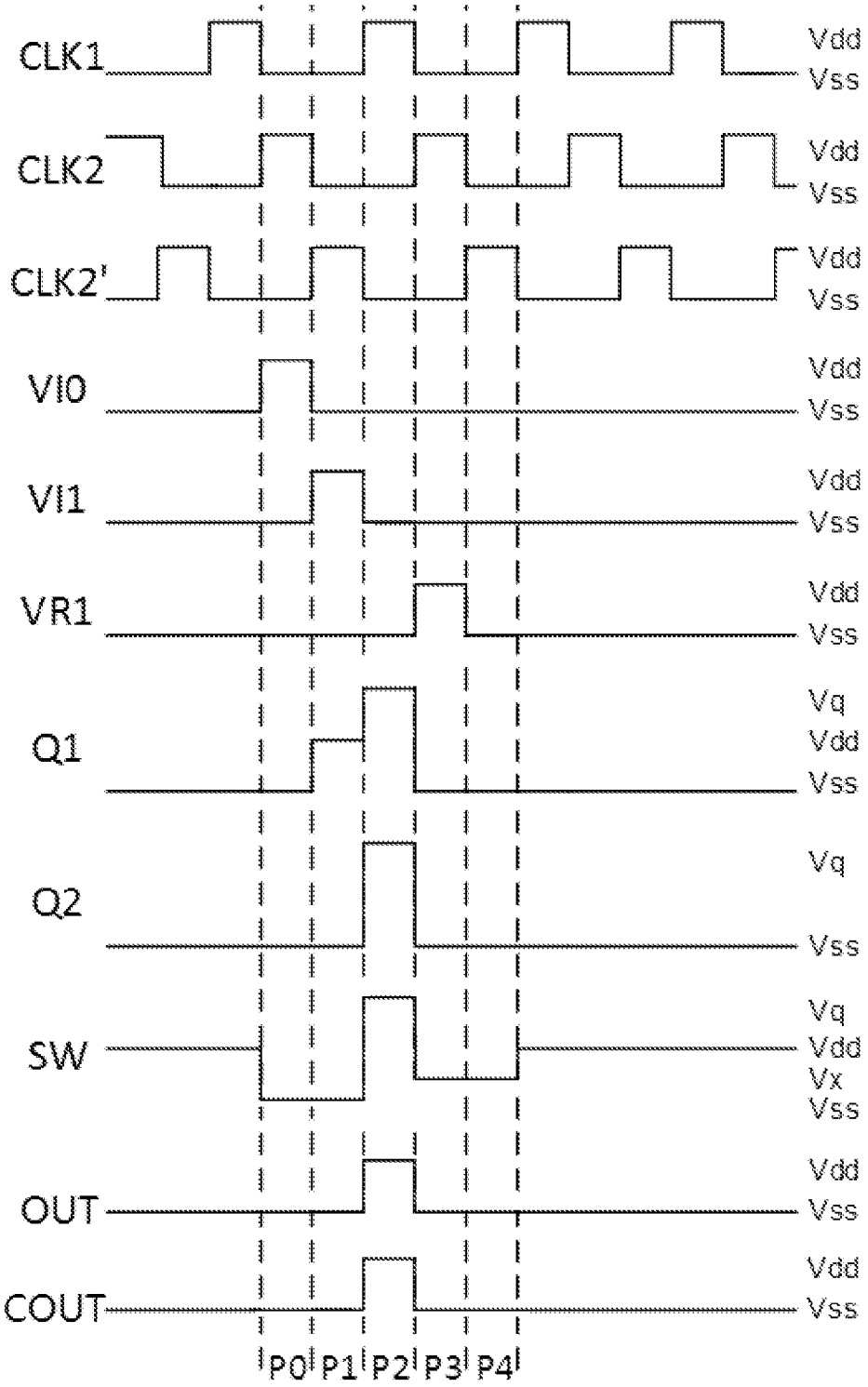
FIG. 5 is an exemplary sequence diagram of the circuit in FIG. 3 or FIG. 4.

FIG. 5 is an exemplary sequence diagram of the shift register unit in FIG. 3 according to one embodiment of the present application. Working process of the shift register unit may be divided into the following five phases: discharging phase P0, pre-charging P1, pull-up phase P2, pull-down phase P3, low voltage maintaining phase P4. The five phases are introduced in detail as follow.

(1) Discharging Phase P0

During this phase, the input signal received at input terminal VI1 is at low voltage level, the signal received at discharge signal input terminal VI0 is at high voltage level, transistor T324 is turned on, and the voltage terminal SW is discharged to low voltage level. This is to guarantee when capacitor C1 is being charged, transistors T321 and T322 are turned off, in order to avoid output transistors being turned on ahead of time and causing mistakes in output.

In another embodiment, this discharging operation may take place in phase P1. However, such arrangement may cause charging and discharging terminal SW at the same time, and may increase leakage power consumption.

(2) Pre-Charging Phase P1

During this phase, the input signal received at input terminal VI1 rises to high voltage level, transistors T311 and T312 are turned on, and capacitor C1 is charged. During this phase, the first clock signal received at first clock signal input terminal CLK1 is at low voltage level, the voltage at terminal SW is kept at low voltage level, transistors T321 and T322 are turned off. No nigh voltage level is transferred to the third electrodes of output transistors T331 and T332, therefore transistors T331 and T332 are turned off. The signal received at the second clock signal input terminal CLK2 is at high voltage level, and the voltages at node Q2, terminal OUT and terminal COUT are kept at low voltage level VSS.

(3) Pull-Up Phase P2

During this phase, the signal received at input terminal VI1 falls to low voltage level, and transistors T311 and T312 are turned off. The clock signal received at the first clock signal input terminal is at high voltage level during this phase, transistor T323 is turned on, the signal received at discharge controlling signal input terminal VI0 is at low voltage level during this phase, transistor T324 is turned off, therefore the voltage at terminal SW rises from low voltage level to high voltage level, switch transistors T321 and T322 are turned on, and voltages at node Q1 is transferred to node Q2.

As the voltage at node Q2 rises, output transistors T331 and T332 are turned on to charge output terminal OUT and cascade output terminal COUT. When the voltages at output terminal OUT and cascade output terminal COUT rise to high voltage level, due to the existence of capacitor C1 and the parasitic capacitance of output transistor T331, voltages at floating nodes Q1 and Q2 may be raised to a level (Vq) higher than the high voltage level VDD because of the self-lift effect. With respect to terminal SW, the turning on of transistor T323 renders terminal SW being charged to high voltage level VDD. In addition, due to the rise of voltages at node Q1 and Q2, the voltage at terminal SW is raised to Vq under the coupling influence of capacitance. As shown in FIG. 5, the voltages at node Q1, node Q2 and terminal SW are all raised to a voltage level (Vq) high than VDD, which guarantees switch transistor T321 and output transistor T331 are turned on during this phase, and guarantees the speed for output transistor T331 to charge output terminal OUT.

In one embodiment, the first electrode and the third electrode of transistor T323 are coupled to VDD which renders transistor T323 like a diode. Therefore, even the voltage at terminal SW reaches to a level higher than VDD, there would be no reverse current flow.

(4) Pull-Down Phase P3

During this phase, the clock signal received at the first clock signal input terminal CLK1 falls to low voltage level, pull-down control signal at pull-down control signal input terminal VR1 is at high voltage level, transistors T341, T342 and T343 are turned on which discharges voltages at output terminal OUT, cascade output terminal COUT, node Q1 and node Q2 to low voltage level. As shown in FIG. 5, the voltage at terminal SW is not pulled down to low voltage level, rather it is pulled down to a voltage (Vx) lower than VDD but higher than VSS. This is because when being pulled down, only capacitance coupling influences the voltage at terminal SW, whereas when being pulled up from low voltage level, the voltage at terminal SW is under the combined influence of capacitance coupling and charging of the third electrode of transistor T321 by transistor T323.

(5) Low Voltage Maintaining Phase P4

During and after this phase, the clock signal received at the second clock signal input terminal CLK2 is at high voltage level, and transistors T351, T352 and T353 are turned on. According to one embodiment, since node Q1 is still connected with node Q2, voltages at output terminal OUT, cascade output terminal COUT, node Q1 and node Q2 are kept at low voltage level VSS.

Specifically, in this embodiment, the clock signal at CKL2 and the clock signal at CLK1 do not have overlaps with respect to effective voltage level (high voltage level). In one embodiment, the first clock signal received at CLK1 is a three-phase signal, therefore, as shown in FIG. 5, the signal application as the second clock signal may be CLK2 and CLK2' which have one phase difference in between.

In the embodiment illustrated in FIG. 3, due to the self-lift of voltage at terminal SW which controls the status of switch transistors T321 and T322, nodes Q1 and Q2 may be connected together more effectively to guarantee the effect of self-lift. Compared to the traditional structure wherein the output transistor is directly connected to the clock signal, circuit in this application avoids clock feedthrough of internal nodes and dynamic power consumption of the output transistor caused by the clock signal.

Figure 4:
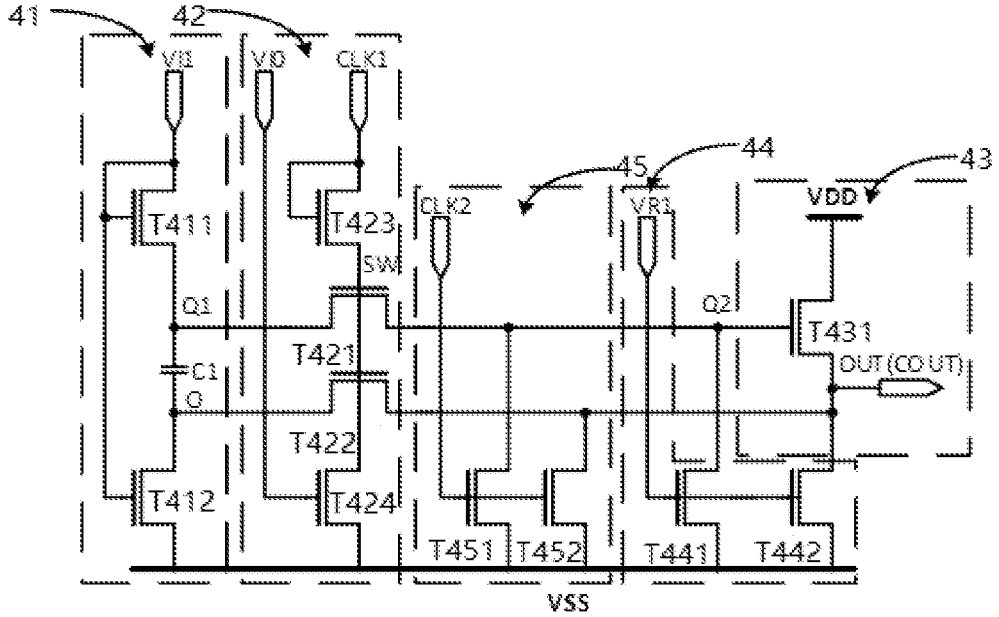
FIG. 4 is an exemplary structural diagram of a shift register unit circuit in accordance with another embodiment of the present application.

FIG. 4 shows a structure diagram of a shift register unit circuit according to one embodiment of the present application. The circuit may include input storing module 41, storage retrieving module 42, output driving module 43, pull-down module 44, and low voltage maintaining module 45.

According to one embodiment, input storing module 41 may include storage capacitor C1 and transistors T411 and T412. A first and a third electrodes of transistor T411 are coupled to input terminal VI1, and a second electrode coupled to a first side of capacitor C1 and node Q1. A first electrode of transistor T412 is coupled to a second side of capacitor C1, a second electrode of T412 is coupled to low voltage supply VSS, and a third node of transistor T412 is coupled to input terminal VI1.

According to one embodiment, storage retrieving module 42 may include transistors T421 and T422 for transferring stored voltage. A first electrode of transistor T421 is coupled to the first side of capacitor C1 and node Q1, a first electrode of transistor T422 is coupled to the second side of capacitor C1. Third electrodes of transistor T421 and T422 are coupled to terminal SW which is configured to receive a controlling signal to control transistors T421 and T422.

According to one embodiment, storage retrieving module 42 may further include transistors T423 and T424. A first electrode and a third electrode of transistor T423 are coupled to a first clock signal input terminal CLK1, a second electrode of transistor T423 is coupled to terminal SW which is also coupled with the third electrodes of transistors T421 and T422. A first electrode of transistor T424 is coupled to a second electrode of transistor T423, a second electrode of transistor T424 is coupled to low voltage supply VSS, and a third electrode of T424 is coupled to discharge controlling signal input terminal VI0.

According to one embodiment, output driving module 43 may include output transistor T431. A first electrode of transistor T431 is coupled to high voltage supply VDD, a third electrode of T431 is coupled to the second electrode of transistor T421 and node Q2. A second electrode of transistor T431 is coupled to output terminals OUT/COUT, such an output signal is used for load driving as well as for output to other shift register unit as input or control signals.

In one embodiment, pull-down module 44 may include a pull-down transistor T441 of node Q2, and a pull-down transistor T442 of terminals OUT/COUT. Second electrodes of such two transistors are coupled to low voltage supply VSS, and third electrodes of such two transistors are coupled to pull-down control signal input terminal VR1. And the difference is that a first electrode of T441 is coupled to node Q2, a first electrode of T442 is coupled to terminals OUT/COUT.

According to one embodiment, low voltage maintaining module 45 may include transistors T451 and T452, second electrodes of which are coupled to low voltage supply VSS, third electrodes of which are coupled to a second clock input terminal CLK2. The difference lies in that a first electrode of T451 is coupled to node Q2, a first electrode of T452 is coupled to terminals OUT/COUT.

FIG. 5 is an exemplary sequence diagram of the shift register unit in FIG. 4 according to one embodiment of the present application. Working process of the shift register unit may be divided into the following five phases: discharging phase P0, pre-charging P1, pull-up phase P2, pull-down phase P3, low voltage maintaining phase P4. The five phases are introduced in detail as follow.

(1) Discharging Phase P0

During this phase, the input signal received at input terminal VI1 is at low voltage level, the signal received at discharge signal input terminal VI0 is at high voltage level, transistor T424 is turned on, and the voltage terminal SW is discharged to low voltage level. This is to guarantee when capacitor C1 is being charged, transistors T421 and T422 are turned off, in order to avoid output transistors being turned on ahead of time and causing mistakes in output.

In another embodiment, this discharging operation may take place in phase P1. However, such arrangement may cause charging and discharging terminal SW at the same time, and may increase leakage power consumption.

(2) Pre-Charging Phase P1

During this phase, the input signal received at input terminal VI1 rises to high voltage level, transistors T411 and T412 are turned on, and capacitor C1 is charged. During this phase, the first clock signal received at first clock signal input terminal CLK1 is at low voltage level, the voltage at terminal SW is kept at low voltage level, transistors T421 and T422 are turned off. No nigh voltage level is transferred to the third electrodes of output transistors T431 and T432, therefore transistors T431 and T432 are turned off. The signal received at the second clock signal input terminal CLK2 is at high voltage level, and the voltages at node Q2 and terminals OUT/COUT are kept at low voltage level VSS.

(3) Pull-Up Phase P2

During this phase, the signal received at input terminal VI1 falls to low voltage level, and transistors T411 and T412 are turned off. The clock signal received at the first clock signal input terminal is at high voltage level during this phase, transistor T423 is turned on, the signal received at discharge controlling signal input terminal VI0 is at low voltage level during this phase, transistor T424 is turned off, therefore the voltage at terminal SW rises from low voltage level to high voltage level, switch transistors T421 and T422 are turned on, and voltages at node Q1 is transferred to node Q2.

As the voltage at node Q2 rises, output transistor T431 is turned on to charge output terminals OUT/COUT. When the voltages at output terminals OUT/COUT and rise to high voltage level, due to the existence of capacitor C1 and the parasitic capacitance of output transistor T431, voltages at floating nodes Q1 and Q2 may be raised to a level (Vq) higher than the high voltage level VDD because of the self-lift effect. With respect to terminal SW, the turning on of transistor T423 renders terminal SW being charged to high voltage level VDD. In addition, due to the rise of voltages at node Q1 and Q2, the voltage at terminal SW is raised to Vq under the coupling influence of capacitance. As shown in FIG. 5, the voltages at node Q1, node Q2 and terminal SW are all raised to a voltage level (Vq) high than VDD, which guarantees switch transistor T421 and output transistor T431 are turned on during this phase, and guarantees the speed for output transistor T431 to charge output terminal OUT.

In one embodiment, the first electrode and the third electrode of transistor T323 are coupled to VDD which renders transistor T423 like a diode. Therefore, even the voltage at terminal SW reaches to a level higher than VDD, there would be no reverse current flow.

(4) Pull-Down Phase P3

During this phase, the clock signal received at the first clock signal input terminal CLK1 falls to low voltage level, pull-down control signal at pull-down control signal input terminal VR1 is at high voltage level, transistors T441 and T442 are turned on which discharges voltages at output terminals OUT/COUT, node Q1 and node Q2 to low voltage level. As shown in FIG. 5, the voltage at terminal SW is not pulled down to low voltage level, rather it is pulled down to a voltage (Vx) lower than VDD but higher than VSS. This is because when being pulled down, only capacitance coupling influences the voltage at terminal SW, whereas when being pulled up from low voltage level, the voltage at terminal SW is under the combined influence of capacitance coupling and charging of the third electrode of transistor T421 by transistor T423.

(5) Low Voltage Maintaining Phase P4

During and after this phase, the clock signal received at the second clock signal input terminal CLK2 is at high voltage level, and transistors T451 and T452 are turned on. According to one embodiment, since node Q1 is still connected with node Q2, voltages at output terminal OUT, cascade output terminal COUT, node Q1 and node Q2 are kept at low voltage level VSS.

Specifically, in this embodiment, the clock signal at CKL2 and the clock signal at CLK1 do not have overlaps with respect to effective voltage level (high voltage level). In one embodiment, the first clock signal received at CLK1 is a three-phase signal, therefore, as shown in FIG. 5, the signal application as the second clock signal may be CLK2 and CLK2' which have one phase difference in between.

In the embodiment illustrated in FIG. 4, another shift register unit circuit is provided. This circuit also offers stable control signal at terminal SW, which avoids clock feed-through of internal nodes and dynamic power consumption of the output transistor caused by the clock signal. In contrast to the circuit shown in FIG. 3, the circuit in FIG. 4 has a simpler structure with fewer transistors, and is applicable for driving smaller load.

Figure 6:
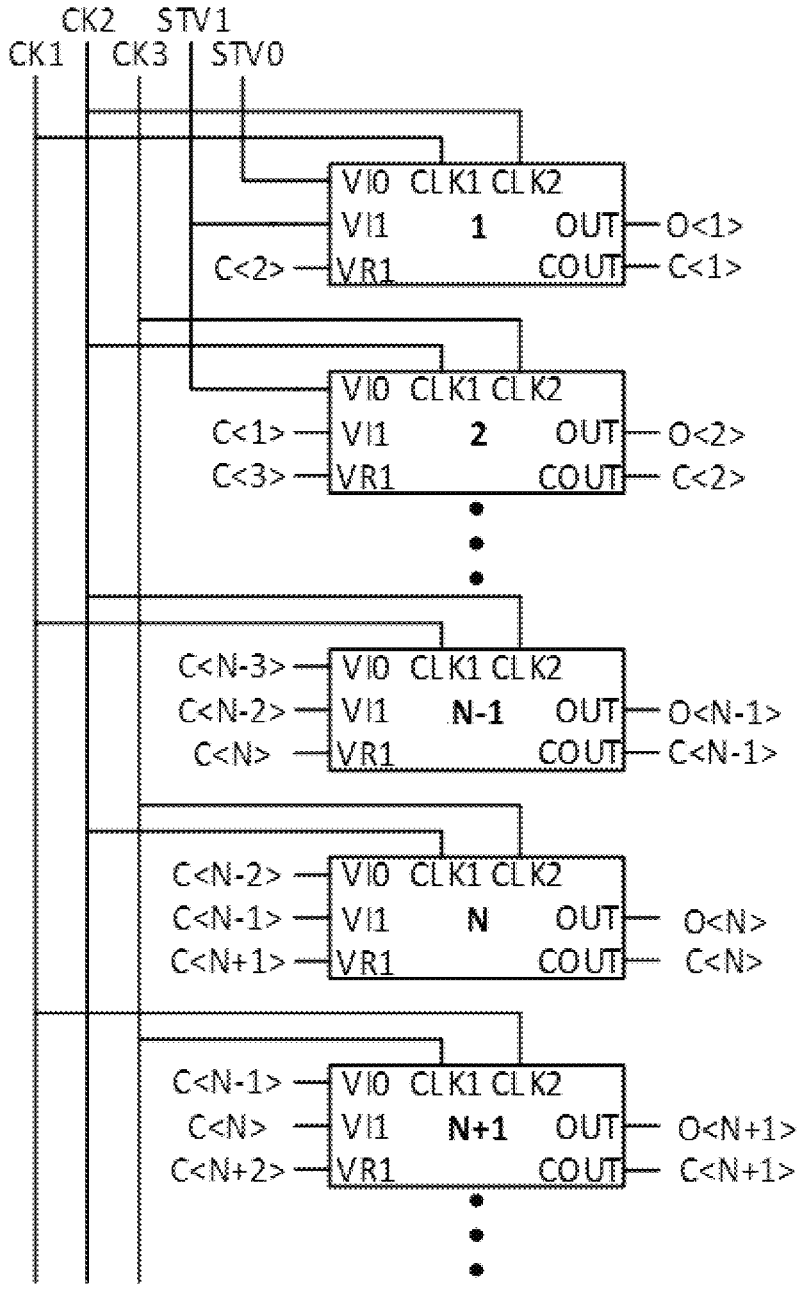
FIG. 6 is an exemplary structural diagram of a gate driver circuit in accordance with one embodiment of the present application.

FIG. 6 is a block diagram of a gate driver circuit for display according to one embodiment of the present application. The gate driver circuit may include a shift register and a plurality of signal lines. In one embodiment, the shift register may include M cascaded shift register units as shown in FIG. 3 or FIG. 4, wherein M may be an integer greater than 4.

According to one embodiment, the gate driver circuit may include five signal lines: a first clock signal CK1, a second clock signal CK2, a third clock signal CK3, a first initial pulse signal STV0, and a second initial pulse signal STV1. High voltage supply VDD and low voltage supply VSS are also provided.

In one embodiment, with respect to the first shift register unit, discharge control signal input terminal VI0 may be configured to receive the first initial pulse signal STV0, input terminal VI1 may be configured to receive the second initial pulse signal STV1, the first clock signal input terminal CLK1 may be configured to receive the first clock signal CK1, the second clock signal input terminal CLK2 may be configured to receive the second clock signal CK2, pull-down control signal input terminal VR1 may be coupled to the cascade output terminal C<2> of the second shift register unit.

In one embodiment, with respect to the second shift register unit, the discharge control signal input terminal VI0 may be configured to receive the second initial pulse signal STV1, input terminal VI1 may be coupled to the cascade output terminal C<1> of the first shift register unit, the first clock signal input terminal CLK1 may be configured to receive the second clock signal CK2, the second clock signal input terminal CLK2 may be configured to receive the third clock signal CK3, the pull-down control signal input terminal VR1 may be coupled to the cascade output terminal C<3> of the third shift register unit.

In one embodiment, with respect to shift register units after the second, for example the Nth unit (N is an integer greater than 3 and no more than M−1), the discharge control signal input terminal VI0 may be coupled to the cascade output terminal C<N−2> of the N−2th unit, input terminal VI1 may be coupled to the cascade output terminal C<N−1> of the N−1th shift register unit, the pull-down control signal input terminal VR1 may be coupled to the cascade output terminal C<N+1> of the N+1th shift register unit.

In one embodiment, with regards to the N−1th shift register unit, the first clock signal input terminal CLK1 may be configured to receive the first clock signal CK1, the second clock signal input terminal CLK2 may be configured to receive the second clock signal CK2; with regards to the Nth shift register unit, the first clock signal input terminal CLK1 may be configured to receive the second clock signal CK2, the second clock signal input terminal CLK2 may be configured to receive the third clock signal CK3. Other combinations of clock signals may be acceptable, as long as signals received at the first clock signal input terminals CLK1 of two adjacent units differ from each other by at least one phase, and the same requirement applies to signals received at the second clock signal input terminals CLK2.

For shift register unit except for the last stage, using the cascade output of next stage as the pull-down control signal of the instant stage does not require waiting for the output operation at the cascade output terminal of the next stage to complete, and a rising edge of the signal at the cascade output terminal of next stage may trigger pull-down operation, therefore the above way of connection may fulfill the pull-down requirement of shift register unit of each stage.

In one embodiment, the shift register of the last stage e.g. the Mth unit, does not have to drive load, and may only be used to generate cascade output signal for the M−1th unit to use as the pull-down control signal. Since the Mth unit does not have to drive load, there is no need to arrange output terminal OUT and corresponding part of circuit configured to drive terminal OUT, and there is no need to arrange the pull-down control signal input terminal for terminal OUT and corresponding pull-down and maintaining transistors.

Figure 7:
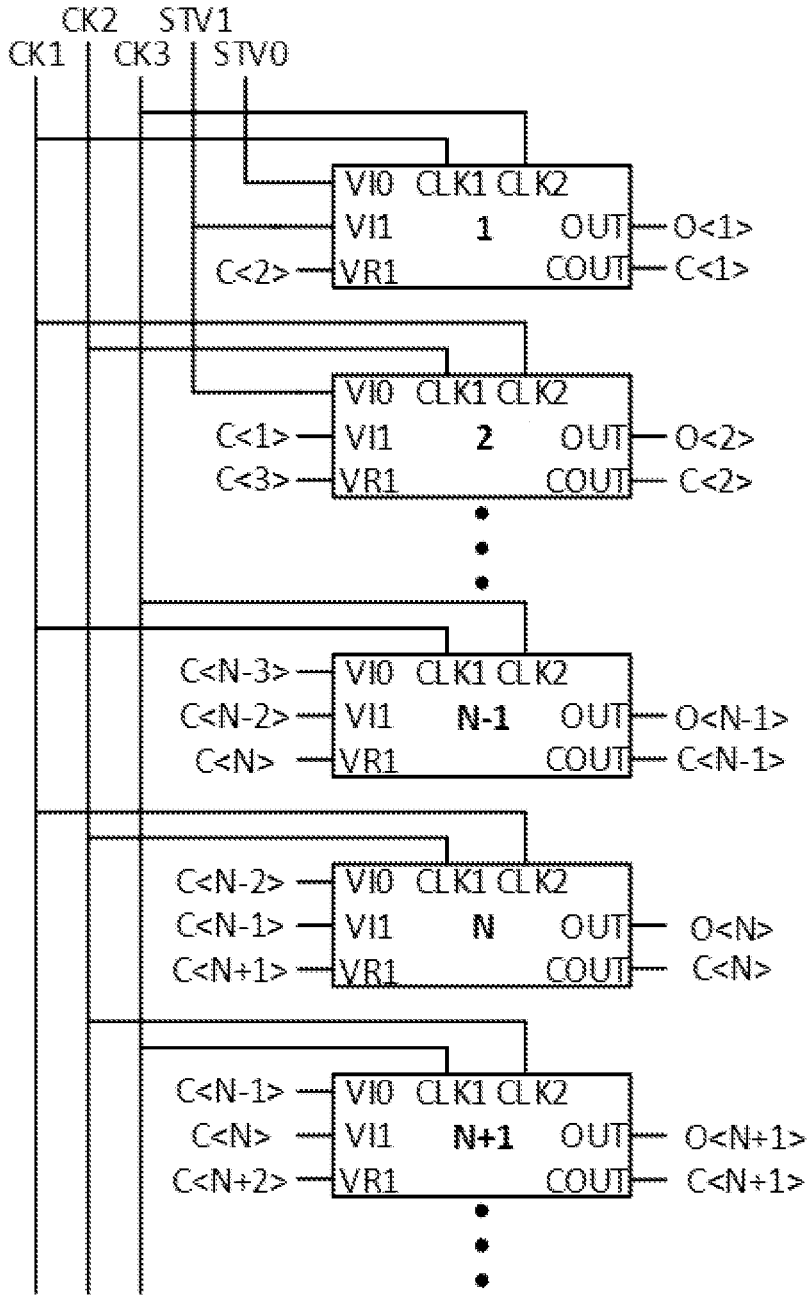
FIG. 7 is an exemplary structural diagram of a gate driver circuit in accordance with another embodiment of the present application.

FIG. 7 illustrates a gate driver circuit according to another embodiment of the present application. Similar to the gate driver circuit, it may include a shift register and a plurality of signal lines. In one embodiment, the shift register may include M cascaded shift register units as shown in FIG. 3 or FIG. 4, wherein M may be an integer greater than 4.

Difference from the circuit shown in FIG. 6, in one embodiment, with regards to the N−1th shift register unit, the first clock signal input terminal CLK1 may be configured to receive the first clock signal CK1, the second clock signal input terminal CLK2 may be configured to receive the second clock signal CK3; with regards to the Nth shift register unit, the first clock signal input terminal CLK1 may be configured to receive the second clock signal CK2, the second clock signal input terminal CLK2 may be configured to receive the third clock signal CK1. Other combinations of clock signals may be acceptable, as long as signals received at the first clock signal input terminals CLK1 of two adjacent units differ from each other by at least one phase, and the same requirement applies to signals received at the second clock signal input terminals CLK2.

Figure 8:
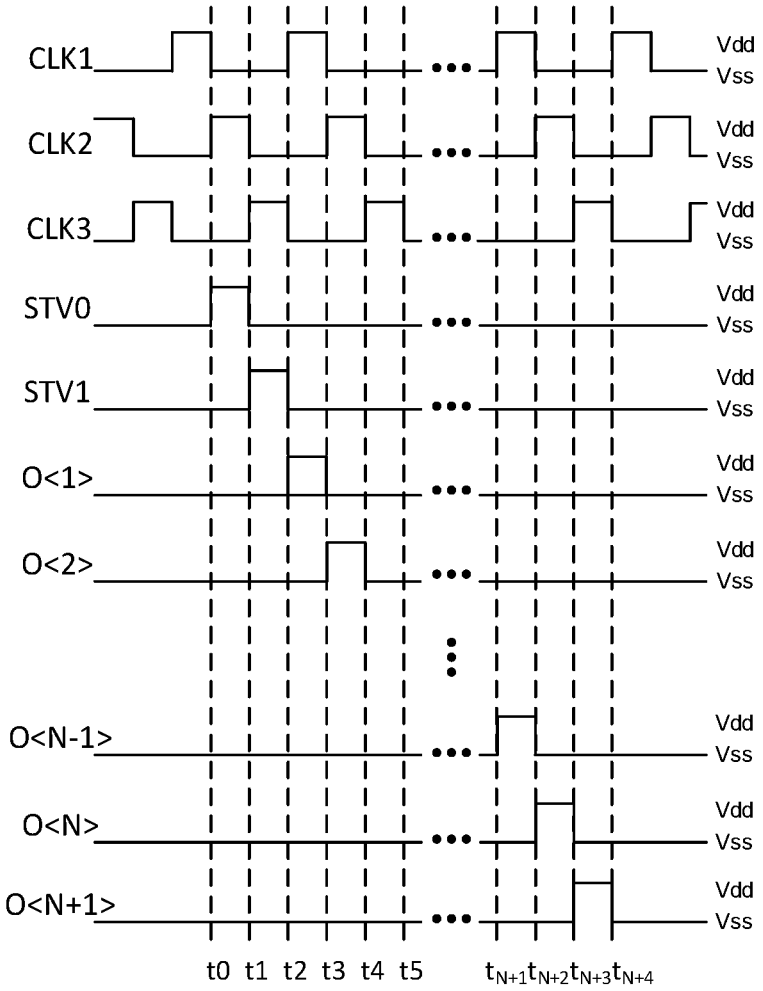
FIG. 8 is an exemplary sequence diagram of the gate driver circuit in FIG. 6.

FIG. 8 is an exemplary sequence diagram of the circuit shown in FIG. 6. It can be seen from FIG. 8, CK1, CK2 and CK3 are clock signals that has one phase difference in between.

With respect to the shift register unit of the first stage, before the signal at input terminal STV1 reaches high voltage level and charging of capacitor C1 starts, and before CK1 reaches high voltage level, the signal at discharge control signal input terminal STV0 reaches high voltage first, which discharges terminal SW and guarantees switch transistors T321 and T322 are not turned on during the charging process.

After that, signal at terminal STV1 reaches high voltage level, C1 is charged, and clock signal CK1 is at low voltage level.

When the signal at terminal STV1 falls down to low voltage level and charging of C1 stops, clock signal CK1 reaches high voltage level, the input signal stored in storing capacitor C1 is transferred to the third electrodes of the output transistors T331 and T332, and output signal of the first stage O<1> is generated at output terminal OUT.

Similarly, with respect to the shift register of the second stage, when clock signal CK2 reaches high voltage level, switch transistors T321 and T322 are turned on, output signal of the second stage O<2> is generated the output terminal OUT of the second stage. M−1 output signals are sequentially generated in a similar manner.

In this embodiment, only one high voltage supply and one low voltage supply are used, which reduces power consumption and increases stability of the circuit. Area of circuit is reduced while performance is maintained.

Figure 9:
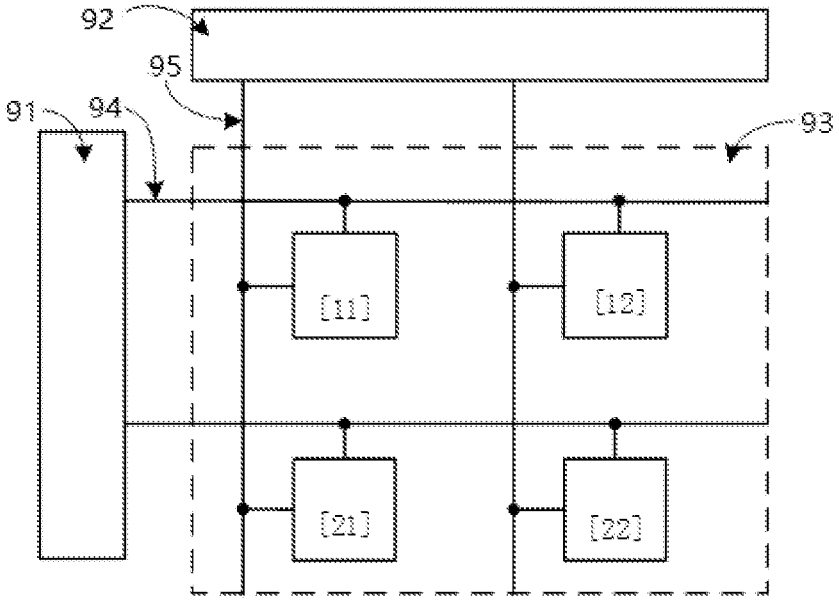
FIG. 9 is a block diagram of a display in accordance with one embodiment of the present application.

FIG. 9 illustrates a display according to one embodiment of the present application. The display may include a gate driver circuit 91, a data driver circuit 92, a pixel array 93, a gate driving line 94, and data driving line 95. Such a display may be LED or OLED display, Quantum dot light emitting display or e-paper display and so forth. Gate driver circuit 91 is configured to generate scan signal which is transferred via gate driving line 94 to pixel array 93 and turning on the pixels row by row so that data may be written into the pixels. Data driver circuit 92 is configured to generate data signal for each row of the pixel array which is transferred via data driving line 95 to the pixel array 93. Gate driver circuit 91 may include the shift register as shown in FIG. 6 or 7 in the present application.

Figure 10:
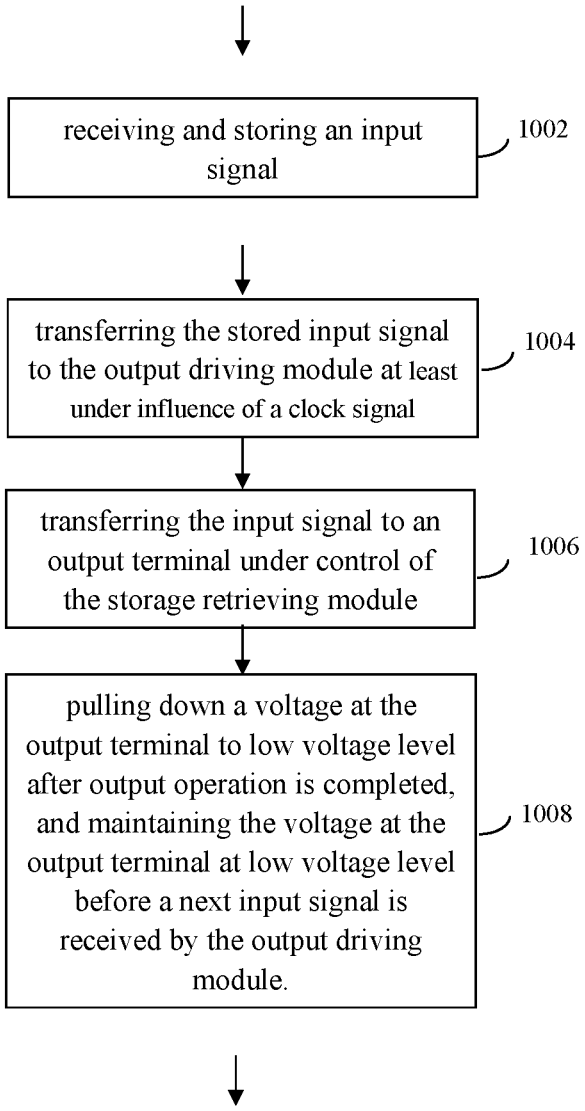
FIG. 10 is a flow diagram of a method for generating gate driving signal in accordance with one embodiment of the present application.

FIG. 10 illustrates a flow diagram for generating gate driving signal according to one embodiment of the present application. In one embodiment, the gate driver circuit of a display may include multiple stages of units. This method may be executed by any of the units except for the last stage, wherein each stage of the unit may include an input storing module, a storage retrieving module, an output driving module, and a pull-down and maintaining module.

At 1002, receiving and storing input signal by input storing module.

At 1004, transferring the stored input signal by storage retrieving module to output driving module, under at least influence of clock signals.

At 1006, transferring the input signal to output terminal by the output driving module under the control of the storage retrieving module.

At 1008, before a next input signal is received by the output driving module, pulling down the voltage at the output terminal to low voltage level and maintaining the voltage at the output terminal at low voltage level by pull-down and maintaining module after output is completed.

Though embodiments of the present application are described in way of examples, people of ordinary skills in the art would understand that they are for illustration purpose instead of limiting purpose. Variations made based on the disclosed of the present application by those of ordinary skills in the art are still within protection scope of the present application.

What is claimed is:

1. A shift register unit circuit, including:

input storing module, configured to receive an input signal at an input terminal and store the input signal;

storage retrieving module retrieving the input signal from the input storing module under influence of at least a first clock signal;

output driving module, coupled to high voltage supply, receiving the input signal from the storage retrieving module, and coupling high voltage supply to a first output terminal under control of the input signal; and pulling-down and maintaining module pulling down a voltage at the first ouput terminal to low voltage level after output operation is completed, and maintaining the voltage at low voltage level until the output driving module receives a next input signal;

wherin the input storing module includes, a storing capacitor configured to store the input signal, a first side of the storing capacitor is coupled to the input terminal through a first switch, a second side of the storing capacitor is coupled to low voltage supply through a second switch, status of the first and second switches is under control of the input signal;

wherein the storage retrieving module includes, a third switch coupled between the first side of the storing capacitor and a third electrode of a first transistor, and a fourth switch coupled between the second side of the storing capacitor and the first output terminal, wherein status of the third and fourth switches is under influence of the first clock signal; and wherein the storage retrieving module further includes a seventh transistor which includes a first and a third electrodes coupled to the first clock signal, and a second electrode coupled to third electrodes of fifth and the sixth transistors.

2. The circuit of claim 1, wherein the output driving module includes, the first transistor including a first electrode coupled to high voltage supply, a second electrode coupled to the first output terminal and the pulling-down and maintaining module, and the third electrode coupled to the storage retrieving module.

3. The circuit of claim 2, wherein the output driving module further includes a second transistor including a first electrode coupled to high voltage supply, a second electrode coupled to a second output terminal, a third electrode coupled to the third electrode of the first transistor, wherein size of the first transistor is larger than size of the second transistor.

4. The circuit of claim 3, wherein the first switch is a third transistor including a first electrode and a third electrode which are coupled to the input terminal, and a second electrode coupled to the first side of the storing capacitor; the second switch is a fourth transistor including a first electrode coupled to the second side of the storing capacitor, a second electrode coupled to low voltage supply, and a third electrode coupled to the input terminal, when the input signal is at high voltage level, the first and second switches are turned on, and the storing capacitor is charged.

5. The circuit of claim 4, wherein the third switch is a fifth transistor including a first electrode coupled to the first side of the storing capacitor, a second electrode coupled to the third electrode of the first transistor, a third electrode coupled to a first clock signal input terminal; the fourth switch is a sixth transistor including a first electrode coupled to the second side of the storing capacitor, a second electrode coupled to the first output terminal, a third electrode coupled to the first clock signal input terminal; the first clock signal reaches high voltage level after charging of the first capacitor is completed, and the third and fourth switches are turned on.

6. The circuit of claim 5, wherein the storage retrieving module further includes an eighth transistor, wherein the eighth transistor includes a first electrode coupled to the second electrode of the seventh transistor, a second electrode coupled to low voltage supply, a third electrode coupled to a discharge control signal input terminal, so that during charging of the storing capacitor, the third and the fourth switches are turned off.

7. The circuit of any of claim 3, wherein the pulling-down and maintaining module includes a pulling-down sub-module and a maintaining sub-module, wherein the pulling-down sub-module includes an eleventh transistor, a twelfth transistor and a thirteenth transistor, second electrodes of these three transistors are coupled to low voltage supply, third electrodes of these three transistors are coupled to the pulling-down control signal input terminal, wherein a first electrode of the eleventh transistor is coupled to the third electrodes of the first transistor and the second transistor, a first electrode of the twelfth transistor is coupled to the second electrode of the first transistor and the first output terminal, and a first electrode of the thirteenth transistor is coupled to the second electrode of the second transistor and the second output terminal; and the maintaining sub-module incudes a fourteenth transistor, a fifteenth transistor and a sixteenth transistor, second electrodes of these three transistors are coupled to low voltage supply, third electrodes of these three transistors are coupled to a second clock signal input terminal, wherein a first electrode of the fourteenth transistor is coupled to the third electrodes of the first transistor and the second transistor, a first electrode of the fifteenth transistor is coupled to the second electrode of the first transistor and the first output terminal, and a first electrode of the sixteenth transistor is coupled to the second electrode of the second transistor and the second output terminal.

8. The circuit of claim 2, wherein the pulling-down and maintaining module includes a ninth transistor and a tenth transistor, wherein the ninth transistor includes a first electrode coupled to the third electrode of the first transistor, a second electrode coupled to low voltage supply, a third electrode coupled to a pulling-down and maintaining control signal input terminal; the tenth transistor includes a first electrode coupled to the first output terminal, a second electrode couple to low voltage supply, and a third electrode the pulling-down and maintaining control signal input terminal.

9. The circuit of claim 2, wherein the pulling-down and maintaining module includes a pulling-down sub-module and a maintaining sub-module, wherein the pulling-down sub-module includes an eleventh transistor and a twelfth transistor, second electrodes of these two transistors are coupled to low voltage supply, third electrodes of these two transistors are coupled to the pulling-down control signal input terminal, wherein a first electrode of the eleventh transistor is coupled to the third electrode of the first transistor, a first electrode of the twelfth transistor is coupled to the second electrode of the first transistor and the first output terminal; and the maintaining sub-module incudes a fourteenth transistor and a fifteenth transistor, second electrodes of these two transistors are coupled to low voltage supply, third electrodes of these two transistors are coupled to a second clock signal input terminal, wherein a first electrode of the fourteenth transistor is coupled to the third electrode of the first transistor, a first electrode of the fifteenth transistor is coupled to the second electrode of the first transistor and the first output terminal.

10. A gate driver circuit, including a shift register which includes M cascaded units, wherein any one of a first to the M−1th units includes a shift register unit circuit, wherein an input terminal of the Nth unit is coupled to a second output terminal of the N−1th unit, a pulling-down control input terminal of the Nth unit is coupled to a second output terminal of the N+1th unit, a discharge control signal input terminal of the N-th unit is coupled to a second output terminal of the N−2th unit, wherein M is an integer greater than 4, N is an integer greater than 3 and no more than M−1;

wherein an input terminal of the first unit is configured to receive an initial input signal, a discharge control signal input terminal is configured to receive an initial discharge control signal, a pulling-down control signal input terminal of the first unit is coupled to a second output terminal of the second unit; a discharge control signal input terminal of the second unit is configured to receive the initial input signal, an input terminal of the second unit is coupled to a second output terminal of the first unit, and a pulling-down control signal input terminal of the second unit is coupled to a second output terminal of the third unit;

wherein the shift register unit circuit includes input storing module, configured to receive an input signal at an input terminal and store the input signal;

storage receiving module retrieving the input signal from the input storing module under influence of at least a first clock signal;

output driving module, coupled to high voltage supply, receiving the input signal from the storage retrieving module, and coupling high voltage supply to a first output terminal under control of the input signal; and pulling-down and maintaining module pulling down a voltage at the first output terminal to low voltage level after output operation is completed, and maintaining the voltage at low voltage level until the output driving module receives a next input signal;

wherein the input storing module inclues, a storing capacitor configured to store the input signal, a first side of the storing capacitor is coupled to the input terminal through a first switch, a second side of the storing capacitor is coupled to low voltage supply through a second switch, status of the first and second switches is under control of the input signal;

wherein the storage retrieving module includes, a third switch coupled between the first side of the storing capacitor and a third electrode of a first transistor, and a fourth switch coupled between the second side of the storing capacitor and the first output terminal, wherein status of the third and fourth switches is under influence of the first clock signal;

wherein the storage retrieving module further includes a seventh transistor which includes a first and a third electrodes coupled to the first clock signal, and a second electrode coupled to third electrodes of fifth and the sixth transistors.

11. The gate driver circuit of claim 10, wherein the Mth unit has a circuit structure according to the shift register unit of claim 2, wherein the Mth unit is only configured to provide a pulling-down control signal to the M−1th unit.

12. A display, including a pixel array, a data driver circuit coupled with the pixel array, and a gate driver circuit according to claim 10 coupled with the pixel array.

13. The display of claim 12, wherein the display is a TFT display and the gate driver circuit is fabricated on the same substrate as the pixel array.

14. A method for generating gate driving signal for a display, including following operations executed by each unit of a shift register of a gate driver circuit of the display, wherein each of the shift register units includes an input storing module, a storage retrieving module, an output driving module, and a pulling-down maintaining module, receiving and storing an input signal by the input storing module under influence of the input signal, the input storing module includes, a storing capacitor configured to store the input signal, a first side of the storing capacitor is coupled to an input terminal through a first switch, a second side of the storing capacitor is coupled to low voltage supply through a second switch, status of the first and second switches is under control of the input signal;

transferring the stored input signal to the output driving module by the storage retrieving module at least under influence of a clock signal, the storage retrieving module includes, a third switch coupled between the first side of the storing capacitor and a third electrode of a first transistor; a fourth switch coupled between the second side of the storing capacitor and an output terminal, wherein status of the third and fourth switches is under influence of the first clock signal; and a seventh transistor which includes a first and a third electrodes coupled to the first clock signal, and a second electrode coupled to third electrodes of fifth and the sixth transistors;

receiving the input signal from the storage retrieving module and coupling high voltage supply to the output terminal by the output driving module under control of the input signal received from the storage retrieving module; and pulling down, by the pulling down and maintaining module, a voltage at the output terminal to low voltage level after output operation is completed, and maintaining, by the pulling down and maintaining module, the voltage at the output terminal at low voltage level before a next input signal is received by the output driving module.

* * * * *